US006312288B1

(12) United States Patent
Genz et al.

(10) Patent No.: US 6,312,288 B1
(45) Date of Patent: Nov. 6, 2001

(54) LOW PROFILE COMBINATION SWITCH AND CONNECTOR ASSEMBLY

(75) Inventors: Earl J. Genz, Des Plaines; James A. Turek, LaGrange, both of IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/696,407

(22) Filed: Oct. 25, 2000

(51) Int. Cl.[7] ..... H01R 11/01

(52) U.S. Cl. ..... 439/628; 439/694; 439/149; 439/397

(58) Field of Search ..... 200/51.02; 439/677, 439/397, 845, 849, 850, 856, 855, 638, 694, 628, 639, 650, 652, 653, 660, 682, 732, 722, 709

(56) References Cited

U.S. PATENT DOCUMENTS 2,294,085 * 8/1942 Hanson ..... 200/51.02
3,555,493 * 1/1971 Baumanis ..... 439/855 X
4,210,382 * 7/1980 Culbertson ..... 439/682
4,349,176 * 9/1982 Thornton ..... 439/667 X
4,472,016 * 9/1984 Rodseth ..... 439/856
4,533,202 * 8/1985 Pohl ..... 439/638
4,593,963 * 6/1986 Endo et al. ..... 439/397
4,669,804 * 6/1987 Munroe ..... 439/652 X
5,030,132 * 7/1991 Hayes et al. ..... 439/397
5,162,004 * 11/1992 Kuzuno et al. ..... 439/845
5,658,158 * 8/1997 Milan ..... 439/639 X

* cited by examiner

*Primary Examiner*—Renee Luebke
(74) *Attorney, Agent, or Firm*—Schwartz & Weinrieb

(57) ABSTRACT

A combination electrical connector and electrical switch comprises a three-sided shroud portion formed upon the electrical switch housing so as to ensure proper electrical connection of the electrical switch and electrical connector in a polarized manner. The electrical connector comprises electrical contacts which include insulation displacement portions for electrical connection to external wiring, and blade reception portions for electrical connection to blade members of the electrical switch wherein all electrical connections are solderless. The blade reception portions of the contacts comprise oppositely disposed, flexible members which are integrally connected together and which are able to self-generate the necessary forces to engage and retain the blade members of the electrical switch.

33 Claims, 5 Drawing Sheets

LOW PROFILE COMBINATION SWITCH AND CONNECTOR ASSEMBLY

FIELD OF THE INVENTION

The present invention relates generally to electrical switch mechanisms and electrical connector components, and more particularly to a new and improved low-profile combination electrical switch and connector assembly which facilitates easy assembly of the switch mechanism and connector component, wherein the connector component and switch mechanism are connected together in a properly oriented or polarized manner, and wherein the electrical contacts disposed within the electrical connector not only facilitate easy connection to external wires through means of insulation displacement techniques, but in addition, the electrical contacts are self-supporting and self-generate requisite forces for electrical connection to tab members of the switch mechanism.

BACKGROUND OF THE INVENTION

Switch mechanisms and operatively associated electrical connector components are often mounted upon support panels, walls, or the like so as to remotely control electrical appliances, lighting fixtures, or other electrical equipment. Space for accommodating the electrical switch mechanisms and their operatively associated electrical connector components, however, is often limited, confined, or simply not readily accessible whereby it becomes necessary to minimize or optimize the component or hardware dimensions. In addition, it is desirable that the electrical switch mechanism and the electrical connector component be able to be electrically connected to, and when required, electrically disconnected from, each other in a relatively simple, properly oriented, and cost-effective manner, preferably by means of non-soldered plug-in and/or insulation displacement type connections. Accordingly, replacement or exchange of the assembly components would be facilitated and expedited. Unfortunately, such an electrical connector and switch mechanism assembly does not presently exist in the current state of the art.

A need therefore exists in the art for a new and improved combination electrical switch mechanism and electrical connector assembly wherein the electrical switch mechanism and the electrical connector has a compact profile enabling the same to be mounted within confined or restricted spatial environments upon support panels, walls, or the like, wherein the electrical switch mechanism and electrical connector can be readily and easily assembled or electrically connected together in a properly oriented or polarized manner by means of solderless connections, and wherein further, the electrical contacts disposed within the electrical connector not only can provide electrical connections to external wiring by means of solderless insulation displacement structure formed upon first ends of the contacts, but in addition, second opposite ends of the contacts can mate with tab contact members of the switch mechanism by means of contact portions which are self-supporting and which self-generate the necessary forces for mating with the tab contact members of the switch mechanism without support from the surrounding housing enclosure.

OBJECTS OF THE INVENTION

Accordingly, it is an object of the present invention to provide a new and improved combination electrical switch mechanism and electrical connector assembly.

Another object of the present invention is to provide a new and improved combination electrical switch mechanism and electrical connector assembly which has a compact profile for facilitating mounting of the assembly within spatially confined or restricted areas upon support panels, walls, or the like.

An additional object of the present invention is to provide a new and improved combination electrical switch mechanism and electrical connector assembly wherein the electrical switch mechanism and electrical connector are provided with mating structure such that the switch mechanism and connector can only be connected together in a predetermined polarized manner.

A further object of the present invention is to provide a new and improved combination electrical switch mechanism and electrical connector assembly wherein the electrical connections between the electrical switch mechanism and the electrical connector, and between the electrical contact members of the connector and external wiring connected thereto are accomplished in a solderless manner, and wherein the electrical contacts of the connector are self-supporting and self-generating in connection with forces required for mating with the tab members of the electrical switch mechanism.

SUMMARY OF THE INVENTION

The foregoing and other objectives are achieved in accordance with the teachings and principles of the present invention through the provision of a new and improved combination electrical switch mechanism and electrical connector assembly which comprises an electrical connector having electrical contacts disposed therein, and a switch mechanism which includes a plurality of dependent tab members for insertion within the electrical connector for mating with the contact members of the electrical connector in a friction-fit solderless manner. The switch mechanism also comprises a three-sided shrouded housing whereby the switch mechanism can only be mated with the electrical connector in a predetermined polarized manner. The contact members of the electrical connector also have insulation displacement portions for terminating external wiring therein in a solderless manner, and the contact members are self-supporting so as not to require external support from the electrical connector housing. The contact members also self-generate the requisite forces required for mating with the dependent tab members of the switch mechanism.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
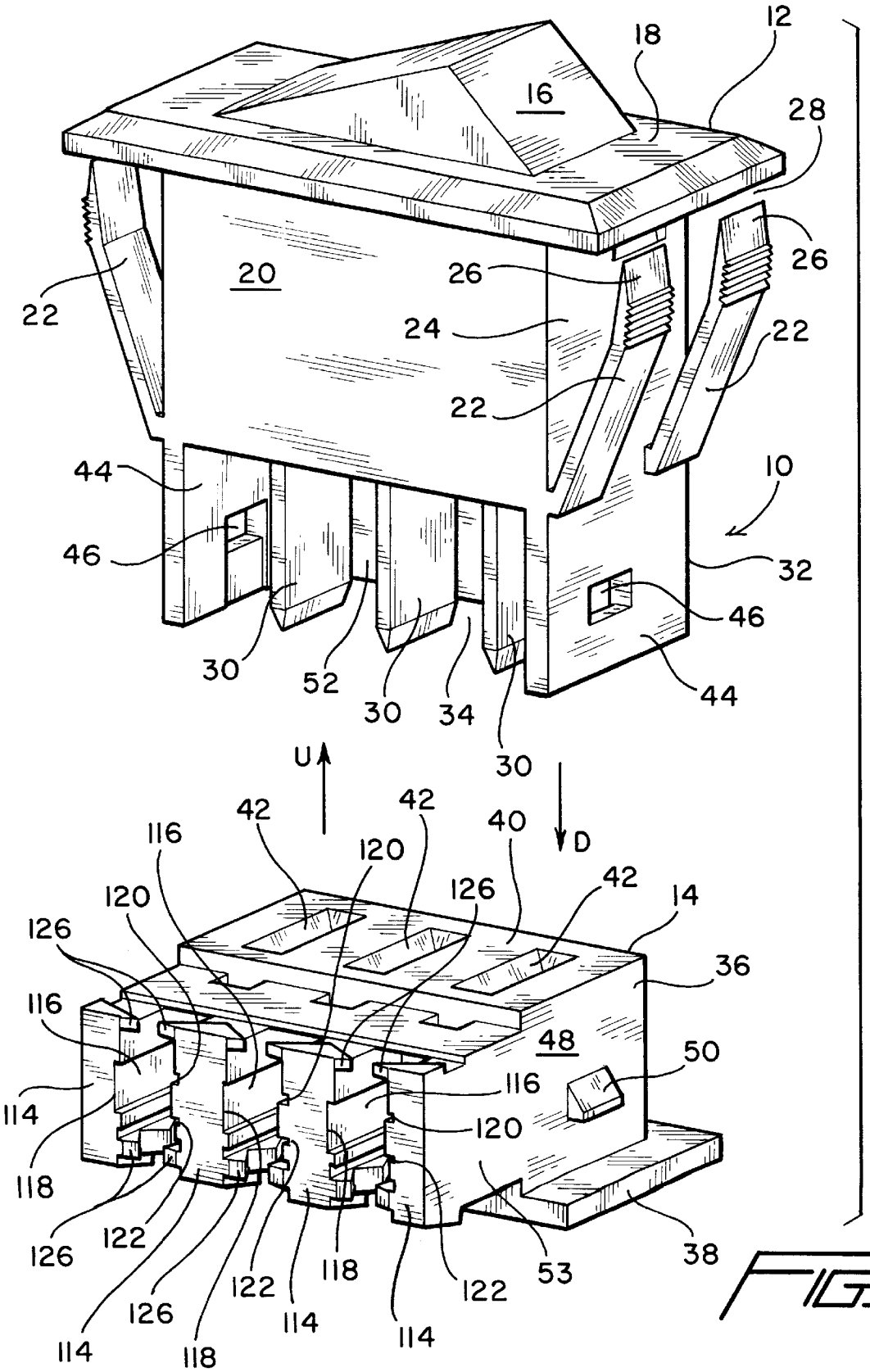
FIG. 1 is an exploded perspective view of a first embodiment of a new and improved combination electrical switch mechanism and electrical connector assembly constructed in accordance with the principles and teachings of the present invention.
Figure 2:
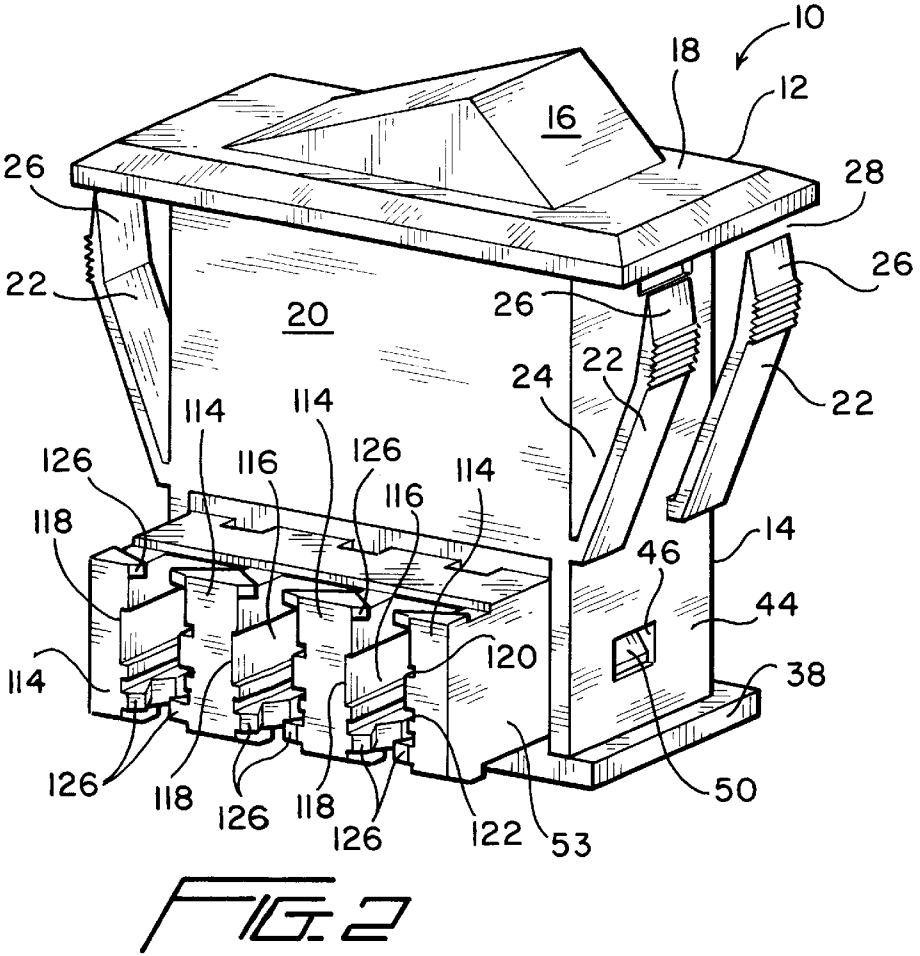
FIG. 2 is an assembled perspective view of the new and improved combination electrical switch mechanism and electrical connector assembly shown in FIG. 1.

Referring now to the drawings, and more particularly to FIGS. 1 and 2 thereof, a first embodiment of the new and improved combination electrical switch mechanism and electrical connector assembly is disclosed, is generally indicated by the reference character 10, and is seen to comprise the electrical switch mechanism 12 and the electrical connector 14. The switch mechanism 12 may comprise, for example, a conventional rocker switch element 16 which is mounted within a switch plate 18 wherein the plate 18 is adapted to be disposed externally upon a support panel, wall, plate, or the like, not shown, when the switch mechanism 12 is mounted upon the support panel, wall, plate, or the like, not shown. In order to facilitate the mounting of the switch mechanism 12 upon the support panel, plate, wall, or the like, not shown, the switch mechanism 12 further comprises a housing 20 which has a configuration which is substantially that of a rectangular parallelepiped, and a pair of flexible mounting fingers 22 is mounted upon respective opposite ends 24 of the switch housing 20 in a cantilevered manner. Each one of the flexible mounting fingers 22 is integrally mounted at its lower end portion upon a lower end region of the switch housing 20, while an upper distal end portion 26 of each finger 22 is disposed at an elevational level which is below the lower edge of switch plate 18 so as to define a space 28 having a predetermined dimension. The dimension of space 28 is adapted to substantially match the thickness dimension of the support panel, wall, plate, or the like, not shown, upon which the combination switch mechanism and electrical connector 10 is to be mounted in a snap-fitted manner.

In particular, the switch mechanism 12 is adapted to be inserted downwardly through an aperture, not shown, defined within the support panel, plate, wall, or the like, also not shown, whereby the flexible fingers 22 will be forced inwardly, from their illustrated positions toward the switch mechanism housing 20, by the side walls of the support panel, plate, wall, or the like, not shown, which define the aperture, not shown. When the upper distal end portions 26 of the fingers 22 pass beneath the lower surface of the support panel, wall, plate, or the like, not shown, the fingers 22 will expand outwardly or snap back to their illustrated positions so as to lockingly engage the undersurface of the support panel, plate, wall, or the like, whereby the switch mechanism 12 will be fixedly mounted upon the support panel, wall, plate, or the like, not shown.

With reference continuing to be made to FIGS. 1 and 2, the switch mechanism 12 is seen to further comprise a plurality of dependent blade-type contact members 30 extending downwardly from the bottom portion of the switch housing 20, and a three-sided shroud 32 integral with the end walls 24 of the switch housing, and the rear wall, not shown, of the switch housing 20, and depending downwardly so as to surround the dependent blade members 30 upon three sides thereof, leaving the fourth front side open, and also define a substantially enclosed space 34. The electrical connector 14 is seen to comprise an electrical connector contact housing 36 which has the configuration of a rectangular parallelepiped and which is supported upon a lower base or foundation 38. The upper surface 40 of the electrical connector housing 36 is seen to comprise a plurality of apertures 42 for receiving or accommodating insertion or reception of the dependent blade members 30 of the switch mechanism 12, and the apertures 42 connect to interior hollow portions of the housing 36 within which electrical contact portions are disposed, as will be more fully disclosed and explained hereinafter, for mating electrical connection with the blade members 30 of the switch mechanism 12 when the switch mechanism 12 and electrical connector 14 are mated together as a result of the switch mechanism 12 being moved downwardly relative to the electrical connector 14 in accordance with the arrow D or as a result of the electrical connector 14 being moved upwardly relative to the switch mechanism 12 in accordance with the arrow U.

Opposite end walls 44 of the dependent shroud are provided with apertures 46, and opposite end walls 48 of the connector housing 36 are provided with detents 50 which are adapted to be lockingly snap-fitted within the apertures 46 of the shroud end walls 44 when the switch mechanism 12 is mated with the electrical connector 14. As can best be appreciated from FIG. 2, when the electrical switch mechanism 12 is mounted upon or mated with the electrical connector 14, the switch housing 20 is disposed atop the connector housing 36 and the three-sided shroud 32 of the switch mechanism 12 substantially encloses the opposite end walls 48,48 and rear wall, not shown, of the electrical connector housing 36. The bottom surface portions of the shroud end walls 44,44, as well as the bottom portion of its rear wall 52, are supported upon the base or foundation 38 of the connector 14. The electrical connector 14 is also provided with an auxiliary housing portion 53 which is integrally formed upon and projects forwardly of the connector housing 36. Auxiliary housing portion 53 is provided for facilitating insertion of the electrical connector contacts into the electrical connector 14 wherein the electrical connector contacts provide electrical connection between external wiring and the contact blade members 30 of the switch mechanism 12. In addtition, as can be further appreciated, due to the interactive structure of the switch mechanism 12 and the electrical connector 14, and in particular, the provision of the three-sided shroud portion 32 upon the switch mechanism 12 as well as the provision of the auxiliary housing portion 53 upon the electrical connector 14, the switch mechanism 12 must be disposed in a uniquely required orientation when the switch mechanism 12 is to be mounted upon the electrical connector 14 whereby, in effect, a polarized connection is established or defined between the switch mechanism 12 and the electrical connector 14 so as to ensure proper mounting or mating of such components with respect to each other.

In connection with the electrical connector contacts, the electrical connector 14 is adapted to have inserted therein three electrical connector contacts for electrical mating with the three dependent blade members 30 of the switch mechanism. Accordingly, with additional reference being made to FIGS. 3 and 4, the new and improved electrical connector contacts are disclosed and are generally indicated by the reference character 54. It is noted that FIG. 3 discloses the electrical contact 54 as disposed in its normal orientation for insertion within the electrical connector 14, while FIG. 4 discloses the electrical contact 54 as disposed in an inverted mode so as to clearly illustrate additional features of the contact 54 which are not apparent from FIG. 3. Accordingly, orientation terminology will be used in connection with the description of the contact 54 as shown in FIG. 3, although such terminology may not be accurate with respect to the disclosure of FIG. 4 due to the inversion of the contact 54 as disclosed in FIG. 4 as compared to its orientation in FIG. 3, however, the component parts of the contact 54 as shown in FIG. 4 which correspond to the same parts of the contact 54 as shown in FIG. 3 will be designated by the same reference characters for clarity and consistency.

Figure 3:
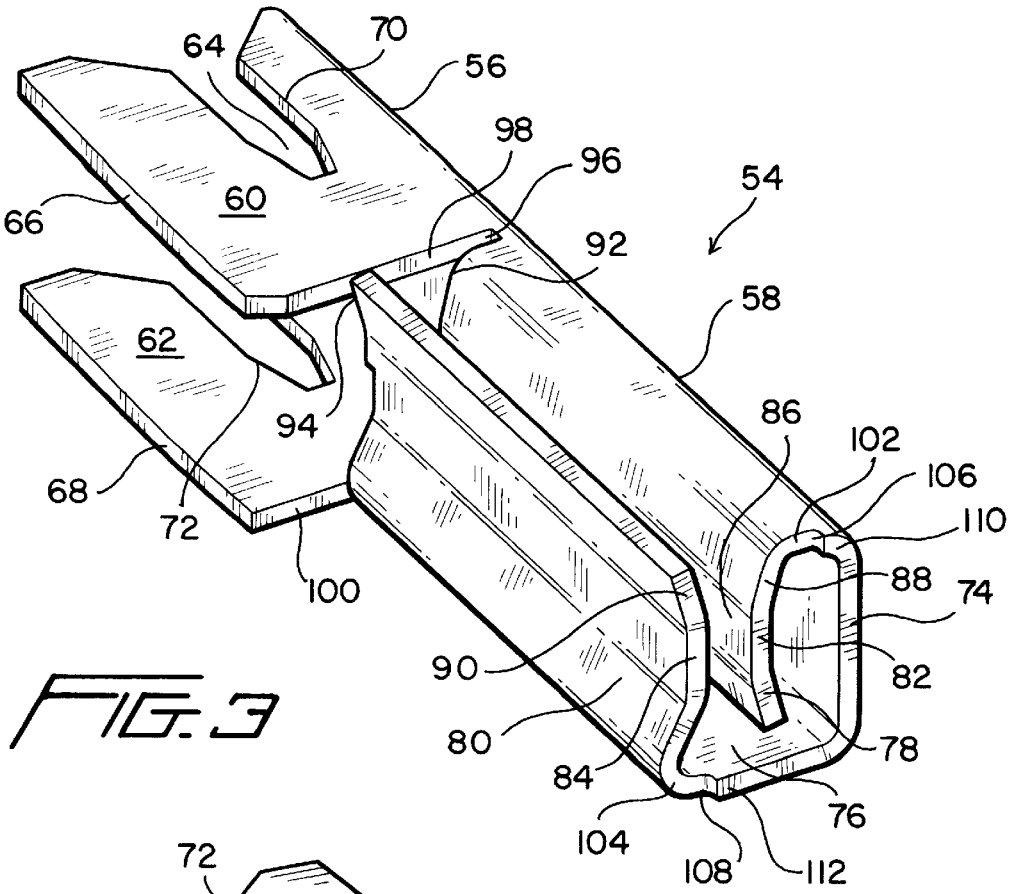
FIG. 3 is a perspective view of one of the new and improved electrical contacts used within the electrical connector of the combination switch mechanism and electrical connector assembly shown in FIGS. 1 and 2.
Figure 4:
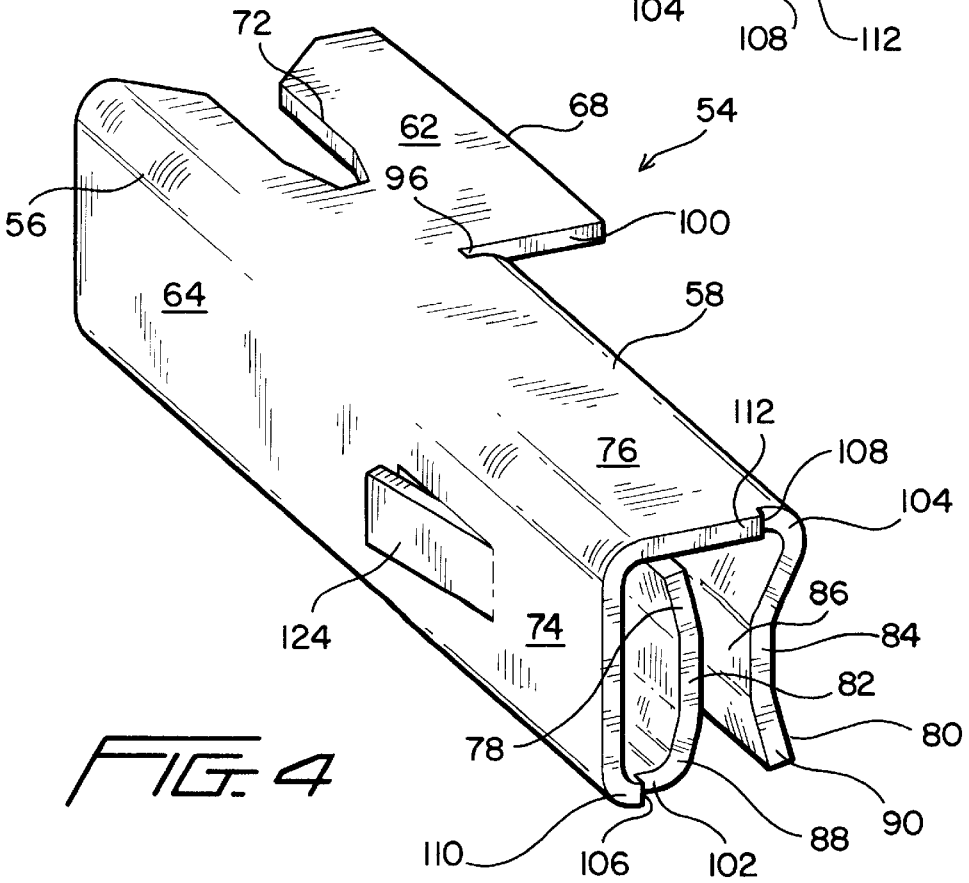
FIG. 4 is an inverted perspective view of the electrical contact shown in FIG. 3.

More particularly, as shown in FIG. 3, each one of the electrical connector contacts 54 is seen to comprise, as considered from the viewpoint of the disposition of the contact 54 when the same is mounted within the electrical connector 14, a forwardly disposed insulation displacement contact portion 56 for electrical connection to external wiring and a rearwardly disposed blade-engaging contact portion 58 for electrical connection to the blade members 30 of the switch mechanism 12. The insulation displacement contact portion 56 is seen to comprise a pair of vertically spaced upper and lower insulation displacement contact members 60, 62. The contact members 60,62 are connected to each other at left side or edge portions thereof, again as considered from the viewpoint of the disposition of the contacts 54 when the contacts 54 are disposed or mounted within the electrical connector 14, by means of a vertically disposed wall member 64, and the right side portions of the contact members 60,62 define free edge portions 66,68. As will be discussed shortly hereinafter, the upstanding wall member 64 and the free edge portions 66,68 of the contacts 54 help serve to support the contacts 54 within the electrical connector 14. In addition, substantially central portions of the contact members 60,62 are of course provided with slotted regions 70,72 which are provided for achieving insulation displacement or insulation stripping procedures in connection with external wires, not shown, to be electrically connected to the electrical connector contacts 54 in accordance with well-known techniques.

The blade-engaging contact portion 58 of each one of the electrical contacts 54 is seen to comprise a left side wall member 74 which, in effect, is an integral extension of the upstanding side wall member 64 of the insulation displacement contact portion 56, and a floor member 76 which is integrally connected at its left edge portion to the lower end of the upstanding wall member 74. A first downwardly extending blade-engaging contact member 78 is integrally connected to the upper end of the upstanding wall member 74, and a second upwardly extending blade-engaging contact member 80 is integrally connected to the right edge portion of the floor member 76. It is seen that the first blade-engaging contact member 78 is provided with a vertically central, longitudinally extending planar portion 82, and the second blade-engaging contact member 80 is similarly provided with a vertically central, longitudinally extending planar portion 84 which is transversely spaced from the planar portion 82 of contact member 78 so as to permit insertion of a respective one of the blade members 30 of the switch mechanism 12 therebetween. The provision of the planar surfaces or portions 82,84 establish surface-to-surface contact with the blade member 30, and in order to facilitate insertion of the blade member 30 into the space or channel 86 defined between the planar portions 82,84, the upper end of the contact member 78 is provided with an outwardly inclined or divergent entrance portion 88 and the upper end of the contact member 80 is similarly provided with an outwardly inclined or divergent entrance portion 90.

It is to be appreciated that both of the blade engaging contact members 78,80 are respectively freely mounted upon the upstanding wall and floor members 74,76 so as to be resiliently flexible, and in this manner, the contact members 78,80 are self-supporting and self-generate the necessary forces in the transverse or lateral direction so as to properly engage a respective one of the blade members 30 when the blade member 30 is inserted into space or channel 86 between the contact portions 82,84. In order to permit the blade-engaging contact members 78,80 to be so flexibly disposed, it is noted that the forward end portions 92,94 of the contact members 78,80 are longitudinally or axially spaced as at 96 from rear edge portions 98,100 of the insulation displacement contact members 60,62. In a similar manner, rear end portions 102,104 of the contact members 78, 80 are longitudinally or axially recessed forwardly as at 106, 108 from the respective rear edge surface portions 110,112 of the upstanding wall and horizontal floor members 74, 76 such that when the electrical contacts 54 are mounted within the electrical connector 14, the rear end portions 102,104 of the contact members 78,80 will not engage or abrade the rear internal wall surface of the electrical connector housing 36. It is also to be appreciated that all electrical connections characteristic of the combination electrical switch and connector assembly 10 of the present invention, that is, between the external wires, not shown, and the insulation displacement contacts 60,62, and between the blade members 30 and the contact members 78,80 are entirely solderless.

With reference again being made to FIGS. 1 and 2, the electrical connector 14, comprising the primary connector housing 36 and the auxiliary connector housing 53 comprises, for example, four upstanding wall members 114 so as to define, in effect, three electrical contact sockets 116 therebetween which extend substantially the full depth of the electrical connector 14 and within which the electrical contacts 54 will be disposed. More particularly, a horizontally disposed or extending channel 118 is defined within a vertically central portion of each left-side interior wall surface of each upstanding wall member 114, and in a similar manner, a pair of vertically spaced horizontally extending channels 120,122 are defined within vertically central portions of each right-side interior wall surface of each upstanding wall member 114. As can therefore be appreciated, when the electrical contacts 54 are to be mounted within the electrical connector 14, electrical contact vertical wall member 64/74 will be disposed within the electrical connector channel 118 while the free edge portions 66,68 of each contact 54 will be respectively disposed within the channels 120,122 of the connector 14.

In order to lock each one of the contacts 54 within its respective socket 116, a rearward portion of each one of the vertical walls defining each channel 118 is provided with an aperture, not shown, for receiving a locking tab 124 which is provided upon the vertical wall member 74 of each contact 54 as best seen in FIG. 4. In addition, each one of the sockets 116 is also provided with an internal upstanding boss or the like, not shown, upon which the floor member 76 of each contact 54 is supported so as to support the rearward portion of each contact 54, particularly in connection with the resistance to any downward force which may be impressed thereon when the blade members 30 of the switch mechanism 12 are being inserted into the spaces 86 of the contact members 54 so as to be electrically engaged with the flexibly movable contact portions 78,80. Lastly, each one of the upstanding wall members 114 has integrally formed upon forward end portions thereof, at upper and lower vertically spaced levels, a plurality of oppositely disposed tab members 126 which serve to retain the external wires, not shown, which are to be inserted into the sockets 116 for electrical connection to the insulation displacement contact members 60,62.

Figure 6:
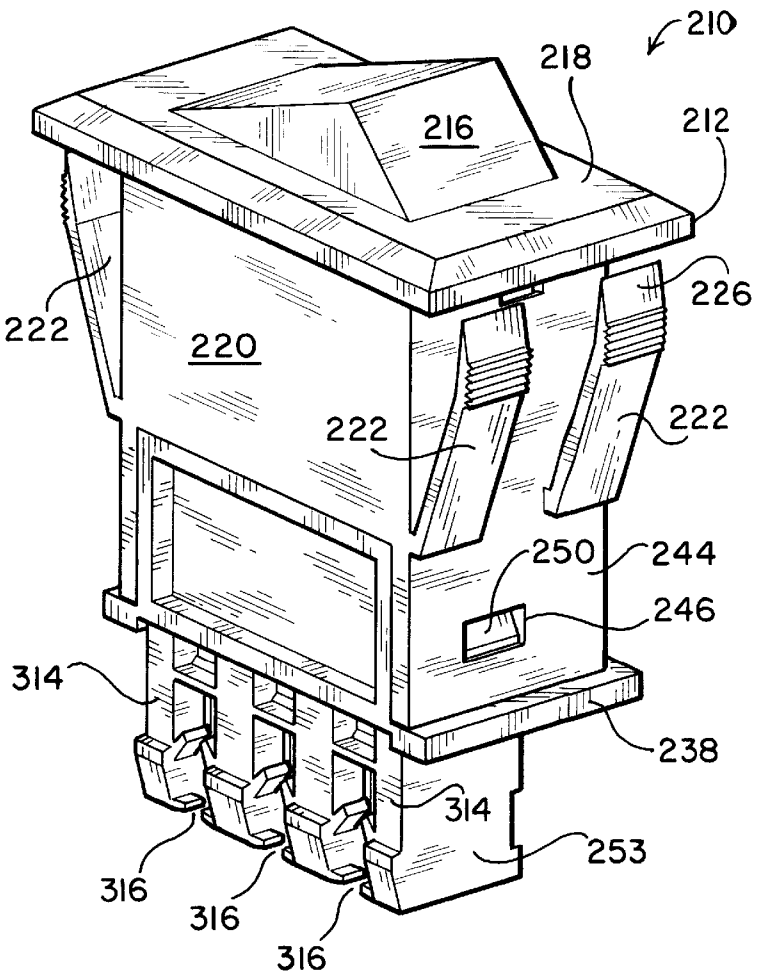
FIG. 6 is an assembled perspective view similar to that of FIG. 2 showing, however, the new and improved combination electrical switch mechanism and electrical connector assembly shown in FIG. 5.
Figure 5A:
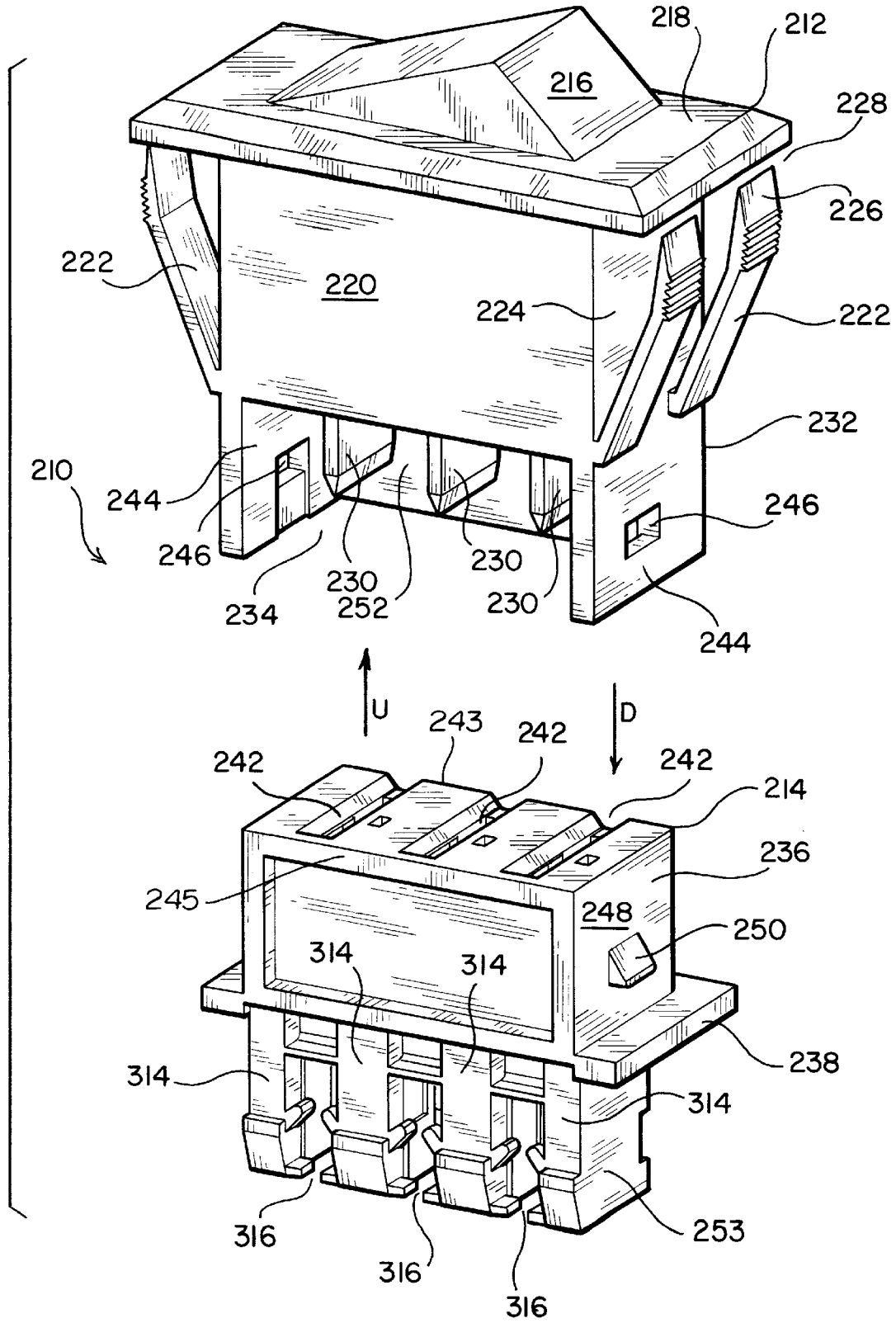
FIG. 5*a* is an exploded, right-side, downward-looking perspective view similar to that of FIG. 1 showing, however, a second embodiment of a new and improved combination electrical switch mechanism and electrical connector assembly constructed in accordance with the principles and teachings of the present invention.
Figure 5B:
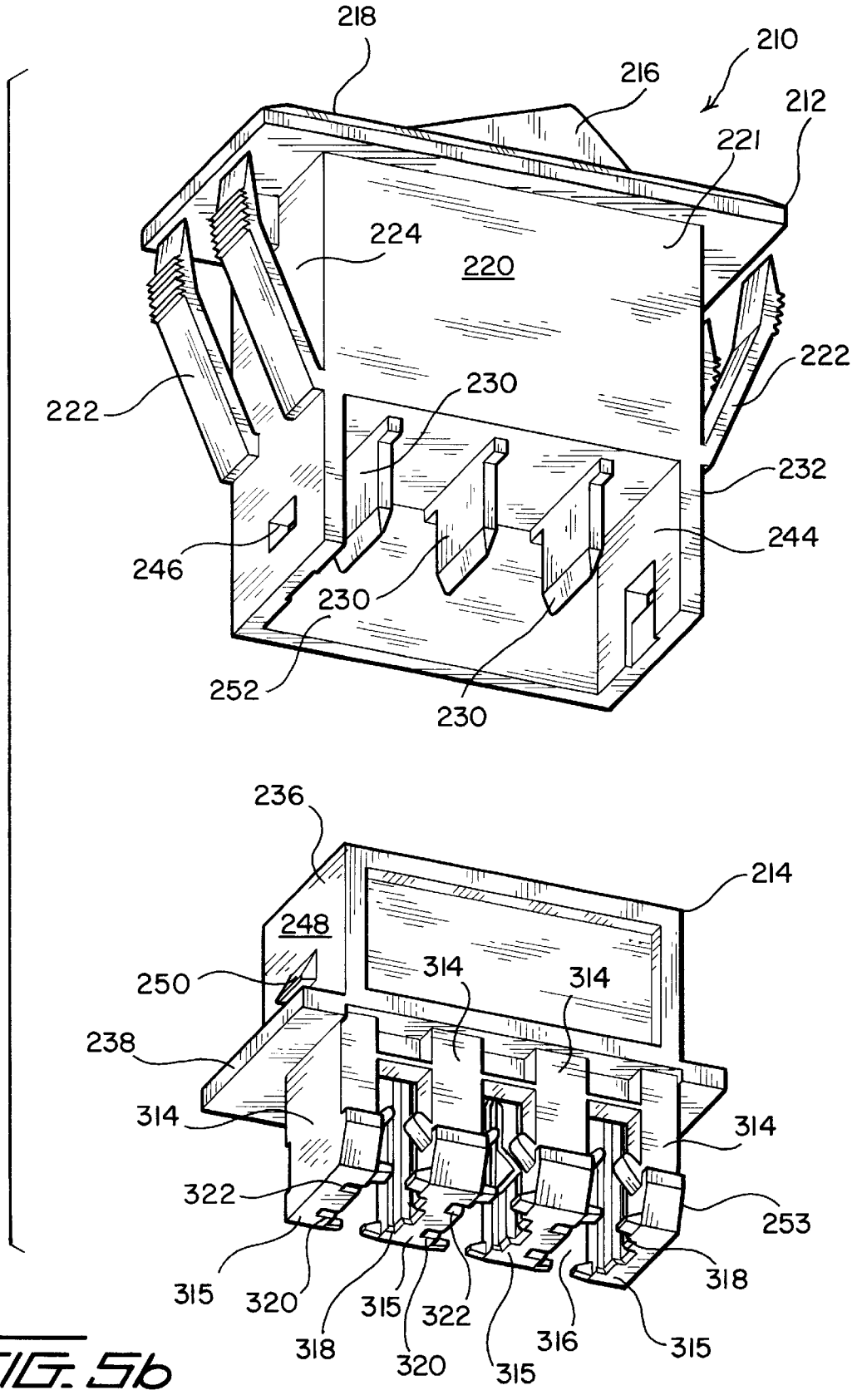
FIG. 5*b* is an exploded, left-side, upward-looking perspective view of the second embodiment of the new and improved combination electrical switch mechanism and electrical connector assembly constructed in accordance with the principles and teachings of the present invention.

With reference now being made to FIGS. 5*a*,5*b*, and 6, a second embodiment of the new and improved combination electrical switch mechanism and electrical connector assembly is disclosed and is generally indicated by the reference character 210. It is to be noted that the second embodiment of the combination electrical switch mechanism and electrical connector assembly 210 as disclosed within FIGS. 5*a*,5*b* and 6 is structurally and operationally similar to the first embodiment of the combination electrical switch mechanism and electrical connector assembly 10 as disclosed within FIGS. 1 and 2, except as will be specifically noted hereinafter, and accordingly component parts of the second embodiment of the combination electrical switch mechanism and electrical connector assembly 210 as disclosed within FIGS. 5*a*,5*b* and 6 which are similar to corresponding parts of the first embodiment of the combination electrical switch mechanism and electrical connector assembly 10 as disclosed within FIGS. 1 and 2 will be designated by corresponding reference characters except that the reference characters will be within the 200 and 300 series. In addition, with respect to those component parts of the second embodiment of the combination electrical switch mechanism and electrical connector assembly 210 as disclosed within FIGS. 5*a*,5*b* and 6 whose function is apparently substantially the same as in the first embodiment of the combination electrical switch mechanism and electrical connector assembly 10 as disclosed 10 within FIGS. 1 and 2, a detailed description of such component parts and their functions is deemed unnecessary and therefore will not be provided.

More particularly, then, it is seen that the major difference between the first embodiment of the combination electrical switch mechanism and electrical connector assembly 10 as disclosed within FIGS. 1 and 2 and the second embodiment of the combination electrical switch mechanism and electrical connector assembly 210 as disclosed within FIGS. 5*a*,5*b* and 6 resides in the fact that, in lieu of the auxiliary housing portion 53 projecting forwardly from a side portion of the electrical connector housing 36 as was the case with the first embodiment of the combination electrical switch mechanism and electrical connector assembly 10 as disclosed within FIGS. 1 and 2, the auxiliary housing portion 253 of the electrical connector 214 projects downwardly from the bottom, base, or foundation portion 238 of the electrical connector housing 236. In this manner, the contact housing 236 is disposed atop the auxiliary housing portion 253 as opposed to the housings being disposed in effect in a side-by-side arrangement as was the case of housing 36 and auxiliary housing 53 of the first embodiment of the combination electrical switch mechanism and electrical connector assembly 10 as disclosed within FIGS. 1 and 2. In this manner, it is also seen that the wires to be mated with the electrical contacts disposed within the auxiliary housing portion 253 will extend horizontally, as opposed to vertically, thus permitting the second embodiment of the combination electrical switch mechanism and electrical connector assembly 210 disclosed within FIGS. 5*a*,5*b* and 6 to be used within applications which may require orientations which are different from those afforded by the first embodiment of the combination electrical switch mechanism and electrical connector assembly 10 as disclosed within FIGS. 1 and 2.

Continuing further, it is seen that the auxiliary housing portion 253 comprises four upstanding wall members 314 which are disposed parallel to each other in a mariner similar to the disposition of the upstanding wall members 114 of the auxiliary housing portion 53 of the first embodiment of the combination electrical switch mechanism and electrical connector assembly 10 as disclosed within FIGS. 1 and 2, however, in lieu of the horizontally disposed channels 118,120,122 extending rearwardly from forwardly disposed faces of the upstanding wall members 114, the upstanding wall members 314 are respectively provided with vertically disposed channels 318,320,322 which extend upwardly from lower or bottom surfaces 315 of the upstanding wall members 314 as best seen in FIG. 5*b*. It is to be further appreciated that the same electrical contacts 54 shown in FIGS. 3 and 4, and previously used in connection with the combination electrical switch mechanism and electrical connector assembly 10, are likewise to be used in connection with the combination electrical switch mechanism and electrical connector assembly 210 except that the electrical contacts 54 will be inserted vertically upwardly within the channels 318,320,322 as opposed to horizontally as was the case when the electrical contacts 564 were inserted within the channels 118,120,122 of the combination electrical switch mechanism and electrical connector assembly 10. Accordingly, it will be further appreciated that when the electrical switch blade members 230 are to be mated with the electrical contacts 54, in lieu of the tip portions 231 of the blade members 230 being inserted between the entrance portions 88,90 of the electrical contacts 54, the tapered tip portions 231 of the blade members 230 will be inserted between the end faces of the electrical contact planar portions 82,84. It is lastly to be appreciated that the polarizing feature characteristic of the first embodiment of the combination electrical switch mechanism and electrical connector assembly 10 is also present within second embodiment of the combination electrical switch mechanism and electrical connector assembly 210 as comprising the three-sided shroud 232 which includes side walls 244 and rear wall 252. In addition, as is also clear from FIGS. 5*a* and 5*b*, the apertures 242 are laterally offset backwardly toward the rear vertical wall surface 243 of the electrical connector housing 236 and away from the front vertical wall surface 245 of the electrical connector housing 236, and similarly for the blade member 230 disposed within the electrical switch housing 220 as being offset laterally rearwardly away from the front wall 221 of the housing 220 and toward the rear wall 252 of the housing shroud 232.

Thus, it may be seen that in accordance with the principles and teachings of the present invention, a new and improved combination electrical switch mechanism and electrical connector assembly has been developed wherein the assembly has a relatively low profile and wherein all electrical connections between the switch mechanism and the electrical connector, as well as between the electrical connector and external wiring, is achieved through means of solderless connections. In addition, the connection between the switch mechanism and the electrical connector is polarized such that the components can only be connected to each other in a predetermined proper mode or orientation. Lastly, the electrical contacts disposed within the electrical connector are self-supporting and self-generate the necessary forces for properly mating with the blade members of the switch mechanism.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A combination electrical switch and electrical connector assembly, comprising:

an electrical switch housing;

an electrical connector housing having a predetermined geometrical shape comprising at least a first surface disposed within a first plane, a first set of apertures defined within said first plane, a second surface disposed within a second plane which is substantially perpendicular to said first plane, and a second set of apertures defined within said second plane;

a plurality of first electrical contacts disposed within said electrical connector housing and having first and second contact portions accessible through said first and second sets of apertures defined within said first and second planes for achieving first and second electrical connections;

a plurality of second electrical contacts disposed upon said electrical switch housing for mated engagement with said first contact portions of said plurality of first electrical contacts disposed within said electrical connector housing through said first set of apertures defined within said first plane so as to achieve said first electrical connections;

said electrical switch housing comprising a single side wall and a pair of opposite end walls so as to define a three-sided shroud which surrounds said plurality of second electrical contacts of said electrical switch housing and thereby defines polarizing structure whereby said electrical switch housing can only be mated with said electrical connector housing in a predetermined orientation so as to ensure proper mating of said plurality of second electrical contacts of said electrical switch housing with said plurality of first electrical contacts of said electrical connector housing;

first locking structure defined upon said electrical connector housing; and second locking structure defined upon said electrical switch housing for lockingly mating with said first locking structure of said electrical connector housing so as to lock said electrical switch housing upon said electrical connector housing and thereby ensure fixed engagement of said plurality of second electrical contacts of said electrical switch housing with said first electrical contacts of said electrical connector housing.

2. The combination as set forth in claim 1, wherein:

said first locking structure defined upon said electrical connector housing comprises a pair of detents integrally mounted upon opposite end walls of said electrical connector housing; and said second locking structure defined upon said electrical switch housing comprises a pair of apertures defined within opposite end walls of said electrical switch housing for permitting said pair of detents of said electrical connector housing to be snap-fitted within said pair of apertures defined upon said electrical switch housing.

3. The combination as set forth in claim 1, wherein said electrical connector housing comprises:

a first housing portion; and a second auxiliary housing portion integrally connected to said first housing portion in a side-by-side horizontally disposed manner.

4. The combination as set forth in claim 1, wherein said electrical connector housing comprises:

a first housing; and a second auxiliary housing portion integrally connected to a bottom portion of said first housing portion such that said first and second housing portions are disposed in a vertical array.

5. The combination as set forth in claim 1, wherein:

said plurality of second electrical contacts of said electrical switch housing comprise blade members.

6. The combination as set forth in claim 5, wherein:

said plurality of first electrical contacts disposed within said electrical connector housing comprise first insulation displacement contact portions for insulation displacement mating with external wiring, and second channel contact portions for receiving said plurality of blade members of said electrical switch housing whereby all electrical connections between the external wiring and said first insulation displacement contact portions of said plurality of first electrical contacts, and between said plurality of blade members of said electrical switch housing and said channel contact portions of said plurality of first electrical contacts of said electrical connector housing are entirely solderless.

7. The combination as set forth in claim 6, wherein:

said electrical connector housing comprises a plurality of vertical wall members defining socket portions between adjacent ones of said vertical wall members for housing said plurality of first electrical contacts.

8. The combination as set forth in claim 7, wherein:

said first insulation displacement contact portions of said plurality of first electrical contacts comprises a pair of horizontally separated insulation displacement contacts integrally connected together at first side edge portions by means of a horizontally extending side wall, and having second free side edge portions; and said plurality of vertical wall members of said electrical connector housing defining said socket portions have a first channel defined within an interior wall surface of a first one of said adjacent ones of said vertical wall members of said electrical connector for housing said horizontally extending side wall of each one of said plurality of first electrical contacts, and a pair of second horizontally spaced channels defined within an opposite interior wall surface of a second one of said adjacent ones of said vertical wall members of said electrical connector for housing said horizontally spaced free edge portions of said insulation displacement contacts.

9. The combination as set forth in claim 6, wherein:

said second channel contact portions for receiving said plurality of blade members of said electrical switch housing comprises a pair of flexible contact members which are integrally connected together and are movable in opposite lateral directions with respect to each other so as to accommodate the disposition of said plurality of blade members of said electrical switch housing between said flexible contact members and to engage said plurality of blade members with a predetermined amount of self-generated force.

10. The combination as set forth in claim 9, wherein:

said second channel contact portions for receiving said plurality of blade members of said electrical switch housing further comprises a base member and a first side wall member integrally connected at a first edge portion thereof to said base member, a first one of said pair of flexible contact members comprising a second side wall member integrally connected at an edge portion thereof to said base member, and a second one of said pair of flexible contact members being integrally connected at an edge portion thereof to a second edge portion of said first side wall member and interposed between said first and second side wall members.

11. The combination as set forth in claim 9, wherein:

said second channel contact portions for receiving said plurality of blade members of said electrical switch housing further comprises a floor member and an upstanding side wall member, a first one of said pair of flexible contact members comprising an upstanding member connected at a lower end portion thereof to said floor member, and a second one of said pair of flexible contact members comprising a dependent member connected at an upper end portion thereof to an upper end portion of said upstanding side wall member.

12. The combination as set forth in claim 11, wherein:

said upstanding side wall member of each one of said second channel contact portions comprises a detent member for lockingly securing said first electrical contacts within said electrical connector housing.

13. The combination as set forth in claim 11, wherein:

said first side wall member of each one of said second channel contact portions comprises a detent member for lockingly securing said first electrical contacts within said electrical connector housing.

14. The combination as set forth in claim 11, wherein:

first end portions of said pair of flexible contact members are spaced from said insulation displacement contact portions, and second end portions of said pair of flexible contact members are spaced from end faces of said floor member and said upstanding side wall member so as to permit said pair of flexible contact members to be freely movable with respect to said insulation displacement contact portions, said floor member, and said upstanding side wall member so as to permit said pair of flexible contact members to accommodate said blade members of said electrical switch housing.

15. The combination as set forth in claim 11, wherein:

first end portions of said pair of flexible contact members are spaced from said insulation displacement contact portions, and second end portions of said pair of flexible contact members are spaced from end faces of said base member and said first side wall member so as to permit said pair of flexible contact members to be freely movable with respect to said insulation displacement contact portions, said base member, and said first side wall member so as to permit said pair of flexible contact members to accommodate said blade members of said electrical switch housing.

16. A combination electrical switch and electrical connector assembly, comprising:

an electrical switch housing;

an electrical connector housing comprising a plurality of vertical wall members defining socket portions between adjacent ones of said vertical wall members for housing a plurality of first electrical contacts;

a plurality of second blade-type electrical contacts disposed upon said electrical switch-housing for mated engagement with said plurality of first electrical contacts disposed within said electrical connector housing, said plurality of first electrical contacts disposed within said electrical connector housing comprising first insulation displacement contact portions for insulation displacement mating with external wiring, and second channel contact portions for receiving said plurality of blade-type electrical contacts of said electrical switch housing whereby all electrical connections between the external wiring and said first insulation displacement contact portions of said plurality of first electrical contacts, and between said plurality of blade-type electrical contacts of said electrical switch housing and said channel contact portions of said plurality of first electrical contacts of said electrical connector housing are entirely solderless;

first locking structure defined upon said electrical connector housing; and second locking structure defined upon said electrical switch housing for lockingly mating with said first locking structure of said electrical connector housing so as to lock said electrical switch housing upon said electrical connector housing and thereby ensure fixed engagement of said plurality of second electrical contacts of said electrical switch housing with said first electrical contacts of said electrical connector housing;

wherein said first insulation displacement contact portions of said plurality of first electrical contacts comprises a pair of vertically separated insulation displacement contacts integrally connected together at first side edge portions by means of a vertically extending side wall, and having second free side edge portions; and said plurality of vertical wall members of said electrical connector housing defining said socket portions have a first channel defined within an interior wall surface of a first one of said adjacent ones of said vertical wall members of said electrical connector for housing said vertically extending side wall of each one of said plurality of first electrical contacts, and a pair of second vertically spaced channels defined within an opposite interior wall surface of a second one of said adjacent ones of said vertical wall members of said electrical connector for housing said vertically spaced free edge portions of said insulation displacement contacts.

17. An electrical contact for use within an electrical connector so as to provide electrical connections between an external wire and a blade contact member of an electrical component to be connected to the electrical connector, comprising:

a first insulation displacement contact portion for insulation displacement mating with an external wire, and a second channel contact portion integrally connected to said first insulation displacement contact portion for receiving a blade member of an electrical component to be electrically connected to the electrical connector whereby all electrical connections between the external wire and said first insulation displacement contact portion of said electrical contact, and between the blade member of the electrical component and said second channel contact portion of said electrical contact, are entirely solderless;

said first insulation displacement contact portion of said electrical contact comprises a pair of vertically separated insulation displacement contacts; and a vertically extending side wall integrally connecting said pair of vertically separated insulation displacement contacts together at first side edge portions with second side edge portions of said pair of vertically separated insulation displacement contacts freely extending so as to not be connected together; and said second channel contact portion for receiving the blade member of the electrical component comprises a floor member and an upstanding side wall member, and a pair of flexible contact members which are integrally connected together and are movable in opposite lateral directions with respect to each other so as to accommodate the disposition of the blade member of the electrical component between said pair of flexible contact members and to engage the blade member of the electrical component with a predetermined amount of self-generated force, a first one of said pair of flexible contact members comprising an upstanding cantilevered member connected at a lower end portion thereof to said floor member, and a second one of said pair of flexible contact members comprising a dependent cantilevered member connected at an upper end portion thereof to an upper end portion of said upstanding side wall member.

18. The electrical contact as set forth in claim 17, wherein:

said upstanding side wall member of said second channel contact portion comprises a detent member for lockingly securing said electrical contact within the electrical connector.

19. The electrical contact as set forth in claim 17, wherein:

first end portions of said pair of flexible contact members are spaced from said insulation displacement contact portions, and second end portions of said pair of flexible contact members are spaced from end faces of said floor member and said upstanding side wall member so as to permit said pair of flexible contact members to be freely movable with respect to said insulation displacement contact portions, said floor member, and said upstanding side wall member so as to permit said pair of flexible contact members to accommodate the blade member of the electrical component.

20. A combination electrical switch and electrical connector assembly, comprising:

an electrical switch housing;

an electrical connector housing having a predetermined geometrical shape comprising at least a first surface disposed within a first plane, a first set of apertures defined within said first surface of said electrical connector housing so as to be laterally offset toward one side of said electrical connector housing, a second surface disposed within a second plane which is substantially parallel to said first plane, and a second set of apertures defined within said second plane;

a plurality of first electrical contacts disposed within said electrical connector housing and having first and second contact portions accessible through said first and second sets of apertures defined within said first and second planes for achieving first and second electrical connections;

a plurality of second electrical contacts disposed upon said electrical switch housing for mated engagement with said first contact portions of said plurality of first electrical contacts disposed within said electrical connector housing through said first laterally offset set of apertures defined within said first surface of said electrical connector housing so as to achieve said first electrical connections;

said electrical switch housing comprising a single side wall and a pair of opposite end walls so as to define a three-sided shroud which surrounds said plurality of second electrical contacts of said electrical switch housing to be mated with said plurality of first electrical contacts of said electrical connector housing through said first laterally offset set of apertures of said electrical connector housing and which thereby defines polarizing structure whereby said electrical switch housing can only be mated with said electrical connector housing in a predetermined orientation so as to ensure proper mating of said plurality of second electrical contacts of said electrical switch housing with said plurality of first electrical contacts of said electrical connector housing;

first locking structure defined upon said electrical connector housing; and second locking structure defined upon said electrical switch housing for lockingly mating with said first locking structure of said electrical connector housing so as to lock said electrical switch housing upon said electrical connector housing and thereby ensure fixed engagement of said plurality of second electrical contacts of said electrical switch housing with said first electrical contacts of said electrical connector housing.

21. The combination as set forth in claim 20, wherein:

said first locking structure defined upon said electrical connector housing comprises a pair of detents integrally mounted upon opposite end walls of said electrical connector housing; and said second locking structure defined upon said electrical switch housing comprises a pair of apertures defined within opposite end walls of said electrical switch housing for permitting said pair of detents of said electrical connector housing to be snap-fitted within said pair of apertures defined upon said electrical switch housing.

22. The combination as set forth in claim 20, wherein said. electrical connector housing comprises:

a first housing; and a second auxiliary housing portion integrally connected to a bottom portion of said first housing portion such that said first and second housing portions are disposed in a vertical array.

23. The combination as set forth in claim 20, wherein:

said plurality of second electrical contacts of said electrical switch housing comprise blade members.

24. The combination as set forth in claim 23, wherein:

said plurality of first electrical contacts disposed within said electrical connector housing comprise first insulation displacement contact portions for insulation displacement mating with external wiring, and second channel contact portions for receiving said plurality of blade members of said electrical switch housing whereby all electrical connections between the external wiring and said first insulation displacement contact portions of said plurality of first electrical contacts, and between said plurality of blade members of said electrical switch housing and said channel contact portions of said plurality of first electrical contacts of said electrical connector housing are entirely solderless.

25. The combination as set forth in claim 24, wherein:

said electrical connector housing comprises a plurality of vertical wall members defining socket portions between adjacent ones of said vertical wall members for housing said plurality of first electrical contacts.

26. The combination as set forth in claim 25, wherein:

said first insulation displacement contact portions of said plurality of first electrical contacts comprises a pair of horizontally separated insulation displacement contacts integrally connected together at first side edge portions by means of a horizontally extending side wall, and having second free side edge portions; and said plurality of vertical wall members of said electrical connector housing defining said socket portions have a first channel defined within an interior wall surface of a first one of said adjacent ones of said vertical wall members of said electrical connector for housing said horizontally extending side wall of each one of said plurality of first electrical contacts, and a pair of second horizontally spaced channels defined within an opposite interior wall surface of a second one of said adjacent ones of said vertical wall members of said electrical connector for housing said horizontally spaced free edge portions of said insulation displacement contacts.

27. The combination as set forth in claim 24, wherein:

said second channel contact portions for receiving said plurality of blade members of said electrical switch housing comprises a pair of flexible contact members which are integrally connected together and are movable in opposite lateral directions with respect to each other so as to accommodate the disposition of said plurality of blade members of said electrical switch housing between said flexible contact members and to engage said plurality of blade members with a predetermined amount of self-generated force.

28. The combination as set forth in claim 27, wherein:

said second channel contact portions for receiving said plurality of blade members of said electrical switch housing further comprises a base member and a first side wall member integrally connected at a first edge portion thereof to said base member, a first one of said pair of flexible contact members comprising a second side wall member integrally connected at an edge portion thereof to said base member, and a second one of said pair of flexible contact members being integrally connected at an edge portion thereof to a second edge portion of said first side wall member and interposed between said first and second side wall members.

29. The combination as set forth in claim 27, wherein:

said second channel contact portions for receiving said plurality of blade members of said electrical switch housing further comprises a floor member and an upstanding side wall member, a first one of said pair of flexible contact members comprising an upstanding member connected at a lower end portion thereof to said floor member, and a second one of said pair of flexible contact members comprising a dependent member connected at an upper end portion thereof to an upper end portion of said upstanding side wall member.

30. The combination as set forth in claim 29, wherein:

said upstanding side wall member of each one of said second channel contact portions comprises a detent member for lockingly securing said first electrical contacts within said electrical connector housing.

31. The combination as set forth in claim 29, wherein:

said first side wall member of each one of said second channel contact portions comprises a detent member for lockingly securing said first electrical contacts within said electrical connector housing.

32. The combination as set forth in claim 29, wherein:

first end portions of said pair of flexible contact members are spaced from said insulation displacement contact portions, and second end portions of said pair of flexible contact members are spaced from end faces of said floor member and said upstanding side wall member so as to permit said pair of flexible contact members to be freely movable with respect to said insulation displacement contact portions, said floor member, and said upstanding side wall member so as to permit said pair of flexible contact members to accommodate said blade members of said electrical switch housing.

33. The combination as set forth in claim 29, wherein:

first end portions of said pair of flexible contact members are spaced from said insulation displacement contact portions, and second end portions of said pair of flexible contact members are spaced from end faces of said. base member and said first side wall member so as to permit said pair of flexible contact members to be freely movable with respect to said insulation displacement contact portions, said base member, and said first side wall member so as to permit said pair of flexible contact members to accommodate said blade members of said electrical switch housing.

* * * * *